United States Patent [19]

Tsai

[11] Patent Number: 4,858,766

[45] Date of Patent: Aug. 22, 1989

[54] SUCKING HOLE STRUCTURE FOR AN ALUMINIUM FOIL BEVERAGE CONTAINER

[76] Inventor: Wen Tsai, 25, Lane 200, Wen-Hwa West Rd., Fon San City, Kaohsiung Hsien, Taiwan, 800

[21] Appl. No.: 284,339

[22] Filed: Dec. 14, 1988

[51] Int. Cl.[4] ..... B65D 5/74

[52] U.S. Cl. ..... 206/628; 206/633; 220/258

[58] Field of Search ..... 220/258; 206/628, 633, 206/605, 608, 609, 615, 217

[56] References Cited

U.S. PATENT DOCUMENTS

| | | | |
|---|---|---|---|
| 3,951,331 | 4/1976 | Smith et al. | 220/258 |
| 4,215,791 | 8/1980 | Brochman | 220/258 |
| 4,520,930 | 6/1985 | Lisiecki | 220/258 |
| 4,556,152 | 12/1985 | Bogren | 220/258 |
| 4,717,039 | 1/1988 | Ayyoubi | 220/258 |

*Primary Examiner*—Joseph Man-Fu Moy

*Attorney, Agent, or Firm*—Fleit, Jacobson, Cohn, Price, Holman & Stern

[57] ABSTRACT

A sucking hole structure for an aluminum foil beverage container, having an oval peeling line punched on the outmost layer of the container and a round peeling line punched on the middle layer of the container, the parts surrounded by the oval peeling line and the round peeling line possible to be peeled off together to become a sucking hole.

2 Claims, 3 Drawing Sheets

SUCKING HOLE STRUCTURE FOR AN ALUMINIUM FOIL BEVERAGE CONTAINER

BACKGROUND OF THE INVENTION

Conventional aluminium foil beverage containers have a round sucking hole provided at the top side face only covered with a layer of aluminium without a layer of paper. In drinking the beverage in the container, a straw is inserted through the sucking hole, but the chances are that dust and bacteria may gather around there and pushed into the beverage by the straw. Then the health of the drinker may be impaired.

Besides, a straw is usually attached on the container for convenience, but it can be completely sunk inside the container, impossible to suck because it is shorter than the height of the container. Or maybe a drinker has to put his/her mouth very close to the sucking hole, and if there should be dust or bacteria lying around there, the dust or the bacteria can be swallowed together by the drinker.

SUMMARY OF THE INVENTION

The object of this invention is to provide a kind of sucking hole structure wherein the hole cannot be polluted and a straw cannot sink down in the container.

The beverage containers with this sucking hole structure are made of three layers of materials, i.e. a coated paper layer as the outmost, a simile paper layer as the middle and an aluminium foil layer as the innermost. An oval peeling line is punched on the coated paper layer and a round peeling line is punched on the simile paper layer at the corresponding location with the oval peeling line. The part surrounded by the round peeling line is compressed less thick than the rest part and adhered to the part surrounded by the oval peeling line of the coated paper layer. Therefore, when the part surrounded by the oval peeling line is peeled off, the part surrounded by the round peeling line can also be peeled off to become a round hole exposing the aluminium foil layer. Then a straw can be made to prick at the hole through the aluminium foil to suck the content.

BRIEF DESCRIPTION OF THE DRAWINGS

This invention will now be described in detail with reference to accompanying drawings wherein.

DETAILED DESCRIPTION OF THE INVENTION

Figure 1:
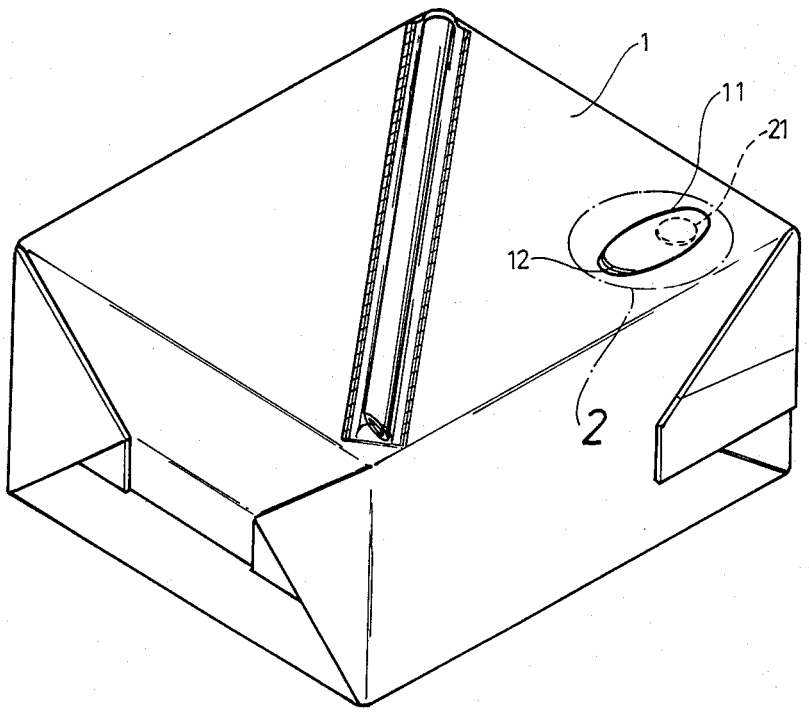
FIG. 1 is a perspective view of the aluminium foil beverage container in accordance with the present invention.

First, as shown in FIG. 1, a rectangular beverage container 1 is provided near a corner on the largest side with a sucking hole which is to be peeled off in case of drinking.

Figure 2:
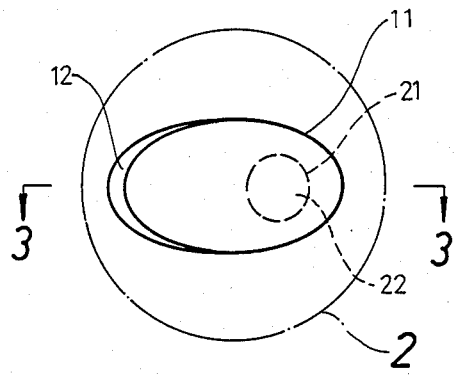
FIG. 2 is a magnified view of the part marked 2 on FIG. 1.
Figure 3:
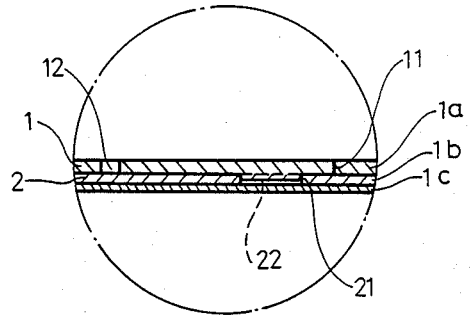
FIG. 3 is a cross-sectional view taken along line 3—3 of FIG. 2.
Figure 4:
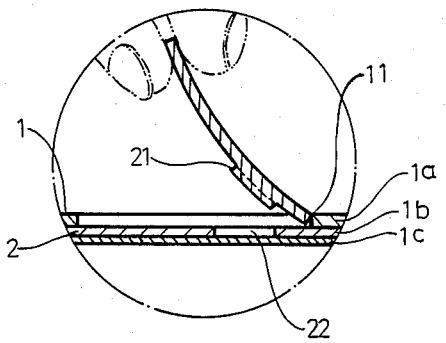
FIG. 4 is a cross-sectional view of the coated paper layer peeled off its position shown in FIG. 3.
Figure 5:
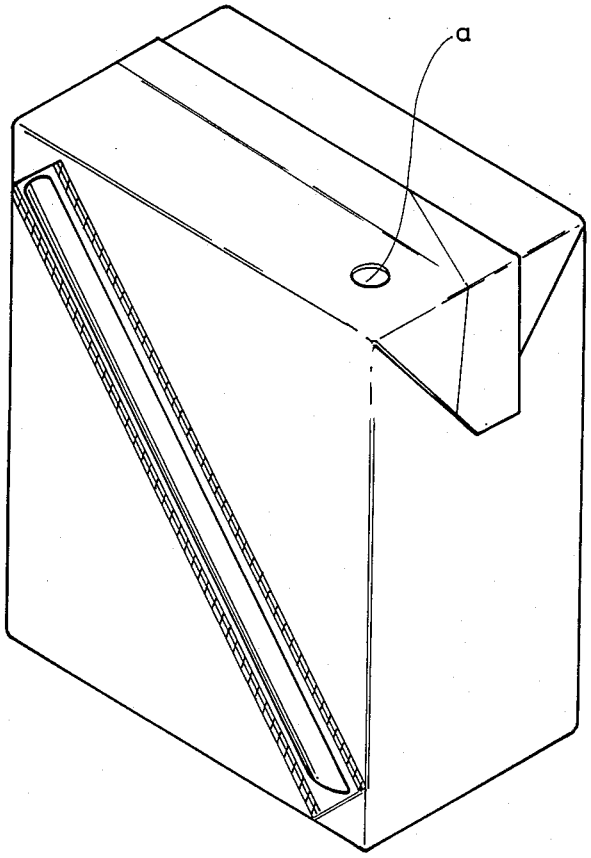
FIG. 5 PRIOR ART
FIG. 5 is a perspective view of a conventional beverage container.

Next, the wall of the container 1 shown in Figures 2 and 3 consists of a coated paper layer 1*a*, a simile paper 1*b* and an aluminium foil layer 1*c*. The coated paper layer 1*a* is punched with an oval peeling line 11 which becomes a peeling opening 12 when the part surrounded with the peeling line 11 is peeled off the coated paper layer 1*a*. A round peeling line 21 is punched on the simile paper layer 1*b* under the part enclosed by the oval peeling line 11, and the enclosed part of the round peeling line 21 is compressed to be thinner than the thickness of the simile paper layer 1*b* and adhered to the part of the oval peeling line of the coated paper layer 1*a*.

As shown in FIG. 3, after the oval peeling line 11 and the round peeling line 21 has been punched, the parts enclosed by said lines 11 and 21 are still remained in its original position in the coated paper layer 1*a* and the simile paper layer 1*b* and an aluminium foil layer 1*c* is attached under the simile paper layer 1*b*.

When a person wants to drink the content of the container 1, he/she peels the part enclosed by peeling line 11 off the coated paper layer 1*a* together with the round part enclosed by the round peeling line 21. Then the part enclosed by the oval peeling line 11 becomes an opening 12 and the part enclosed by the round peeling line 21 becomes a round hole 22 in the simile paper layer 1*b* and the aluminium foil layer appears. Then a straw is made to prick at the hole 22 through the aluminium foil layer 1*c* for sucking the content.

The sucking hole 22 is made near a corner on the largest side of the container 1 and the straw is made as long as the longest side face of the container 1, so the straw can never completely drop inside the container 1 when inserted through the sucking hole 22 for drinking. Besides, the sucking hole 22 is wholly covered before using so that dust or bacteria can hardly attach around the sucking hole 22 to endanger the health of a drinker.

What is claimed is:

1. A sucking hole structure for an aluminium foil beverage container made of three layers, i.e. a coated paper layer as the outermost, a simile paper layer as the middle and an aluminium foil layer as the innermost, having the sucking hole made at a corner of a side face of the container, said sucking hole covered and surrounded by an oval peeling line punched on the coated paper layer, said sucking hole punched with a round peeling line on the simile paper layer and compressed to become less thick than the rest part and adhered with the part enclosed by the oval peeling line, and the part enclosed by the round peeling line with part enclosed by the oval peeling line possible to be peeled off to become said sucking hole.

2. A sucking hole structure for an aluminium foil beverage container as claimed in claim 1, wherein said sucking hole is provided near a corner of the largest side of the container.

* * * * *